United States Patent [19]

Kawachi et al.

[11] Patent Number: 4,557,241

[45] Date of Patent: Dec. 10, 1985

[54] FUEL INJECTION MEANS HAVING AIR BLEED MEANS

[75] Inventors: Masayuki Kawachi; Yasushi Kono, both of Hiroshima, Japan

[73] Assignee: Mazda Motor Corporation, Hiroshima, Japan

[21] Appl. No.: 344,971

[22] Filed: Feb. 2, 1982

[30] Foreign Application Priority Data

Feb. 4, 1981 [JP] Japan ..... 56-15213

[51] Int. Cl.[4] ..... F02B 23/00

[52] U.S. Cl. ..... 123/585; 123/559; 123/472

[58] Field of Search ..... 123/308, 432, 470, 472, 123/585, 590, 559, 478, 489; 60/605

[56] References Cited

U.S. PATENT DOCUMENTS

| | | | |
|---|---|---|---|
| 2,995,890 | 8/1961 | Dolza | 123/432 |
| 3,661,129 | 5/1972 | Uozumi et al. | 123/533 |
| 4,047,912 | 9/1977 | Markland | 123/559 |
| 4,243,003 | 1/1981 | Knapp | 123/470 |
| 4,311,042 | 1/1982 | Hosoya et al. | 123/478 |
| 4,351,304 | 9/1982 | Schweizer | 123/472 |
| 4,361,126 | 11/1982 | Knapp et al. | 123/585 |

FOREIGN PATENT DOCUMENTS

| | | | |
|---|---|---|---|
| 0866873 | 2/1953 | Fed. Rep. of Germany . | |
| 3013086 | 10/1981 | Fed. Rep. of Germany . | |
| 0060622 | 5/1979 | Japan . | |
| 0071222 | 6/1979 | Japan | 60/605 |
| 0164776 | 12/1980 | Japan | 123/585 |

OTHER PUBLICATIONS

"Combination of Turbocharging and Rampipes for a High Performance Passenger Car Gasoline Engine", *Motortechnishce Zeitschrift,* 40(1979)12, pp. 581–584.

"Auto-Motor-Sport", *Test und Technik,* No. 9 (1976), pp. 72–83.

*Primary Examiner*—Parshotam S. Lall
*Assistant Examiner*—W. R. Wolfe
*Attorney, Agent, or Firm*—Fleit, Jacobson, Cohn & Price

[57] ABSTRACT

A fuel injection device for supercharged engine including a supercharging blower located in the intake passage upstream of the throttle valve. The fuel injection device includes a fuel injection valve located downstream of the throttle valve. An air bleed system is provided so as to inject bleed air to the fuel injected from the fuel injection valve. The air bleed system includes a bleed air passage having an upstream end opening to the intake passage between the supercharging blower and the throttle valve so that any backflow through the bleed air passage can be prevented even under a heavy load engine operation.

12 Claims, 1 Drawing Figure

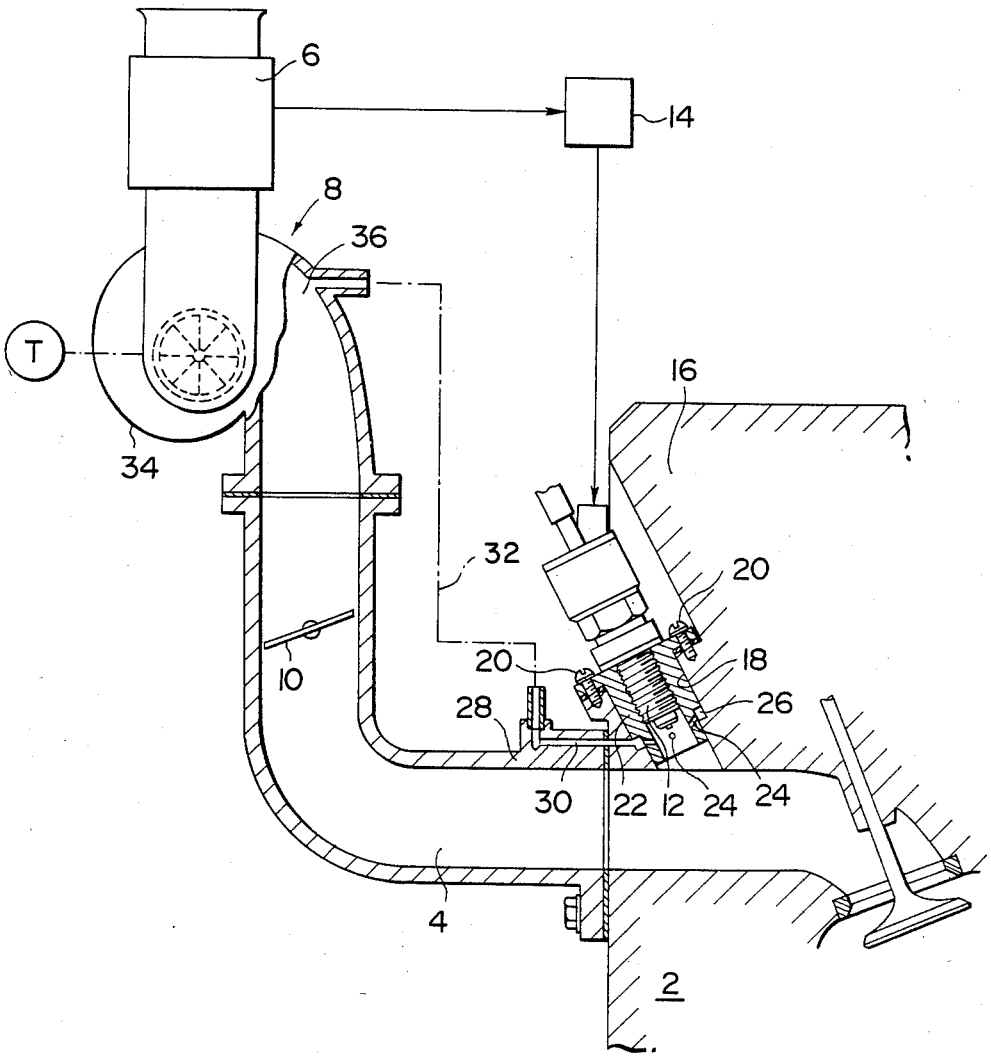
6
14
8
36
T
16
34
32
20
10
20
18
28
26
30
22
12
24
24
4
2

FUEL INJECTION MEANS HAVING AIR BLEED MEANS

The present invention relates to a fuel injection device for supercharged engines and more particularly to a fuel injection device for an engine having a supercharger provided in the intake passage upstream of the throttle valve, a fuel injection valve provided in the intake passage downstream of the throttle valve and an air bleed arrangement for supplying bleed air to the fuel discharged from the fuel injection valve.

In general, a fuel injection type engine is considered as being advantageous in respect to fuel economy and air pollutant gas emissions as compared with a carburetor type engine because the fuel injection device can provide a supply of fuel more precisely in accordance with the intake air flow than a carburetor does. However, in such a fuel injection type engine, problems have been encountered in that, under a light load operation in which the throttle valve is in the minimum or small opening position, the intake air flow speed is so small that an adequate atomization of fuel cannot be accomplished. It has therefore been proposed to provide the fuel injection valve with an air bleed device for blowing bleed air into the fuel discharged from the fuel injection valve to thereby promote atomization of the fuel. For example, in Japanese patent application No. 52-127290 filed on Oct. 25, 1977 and disclosed for public inspection on May 16, 1979 under the disclosure number of 54-60622, there is shown a fuel injection nozzle provided around the body thereof with a spiral air bleed passage so that a swirl of bleed air is produced to atomize the fuel discharged from the nozzle.

In the known types of fuel injection devices, the upstream end of the air bleed passage is opened usually to the air cleaner wherein the atmospheric pressure prevails and the bleed air is drawn under the intake suction pressure in the intake passage. Where this type of fuel injection system is applied to a supercharged engine having a supercharger located upstream of the throttle valve, there may be occasions wherein the intake pressure is above the atmospheric pressure so that a backflow may be produced throught the air bleed passage to the atmosphere. This may cause a further air pollution problem and leads to a loss of fuel economy.

It is therefore an object of the present invention to provide a fuel injection device for a supercharged engine having air bleed means which is free from the aforementioned problems.

Another object of the present invention is to provide air bleed means for a fuel injection device of a supercharged engine which does not have problems of backflow of the intake gas.

A further object of the present invention is to provide air bleed means for a fuel injection device of a supercharged engine which can provide are effective atomization of fuel throughout operation range of the engine.

According to the present invention, the above and other objects can be accomplished by an intake system for internal combustion engines comprising intake passage means provided with throttle valve means, supercharging means provided in said intake passage means upstream of the throttle valve means, fuel injection means provided in said intake passage means downstream of the throttle valve means for injecting a metered amount of fuel to said intake passage means, air bleed means for discharging bleed air to the fuel from the fuel injection means, said air bleed means including bleed air passage means having upstream end opened to the intake passage means between said supercharging means and said throttle valve means. The supercharging means amy comprise blower means having blower case means formed with an inlet and outlet portions and the upstream end of the bleed air passage means may be opened to the outlet portion of the blower case means. The blower means may be of a centrifugal type having a scrolled outlet portion and the upstream end of the bleed air passage means may open to such scrolled outlet portion.

According to the features of the present invention, the upstream end of the bleed air passage means is always subjected to a pressure which is higher than that prevailing around the fuel injection means. Therefore, it is possible to prevent any backflow through the bleed air passage means. Further, it is possible to maintain a stronger air bleed than in conventional arrangements so that improved results can be obtained in respect of fuel atomization. Where the upstream end of the bleed air passage means is opened to the outlet portion of the blower case, it is possible to maintain the strongest air bleed effect and it may be possible even to utilize a ram pressure.

The above and other objects and features will become apparent from the following descriptions of a preferred embodiment taking reference to the accompanying drawing which is a fragmentary sectional view showing the engine intake system embodying the features of the present invention.

Referring now to the drawing, there is shown an engine 2 having an intake pipe 28 formed with an intake passage 4 which is provided with an air flowmeter 6, a supercharger 8, a throttle valve 10 and a fuel injection valve 12 which are arranged in this order from the upstream side of the intake passage 4. The fuel injection valve 12 is associated with a control circuit 14 such as a microprocessor to be controlled thereby. The control circuit 14 receives inputs from the air flowmeter 6 and other devices (not shown) which produce signals representing engine operating conditions and calculates the amount of fuel which is to be supplied to the engine.

The fuel injection valve 12 is mounted on a socket 22 which is fitted to a mounting hole 18 in the engine cylinder head 16 and secured thereto by means of screws 20. The socket 22 is formed at the end portion facing to the intake passage 4 with a plurality of bleed air injecting apertures or nozzles 24 which are penetrating the wall of the socket 22 in substantially radial directions so that the bleed air passing therethrough is directed to the fuel discharged from the fuel injection valve 12. Around the socket 22, there is formed an annular groove 26 which communicates with the apertures 24 in the socket 22. The groove 26 is connected through a bleed air passage 30 formed in the cylinder head 16 and the intake pipe 28 and through a bleed air conduit 32 with the intake passage 4 between the supercharger 8 and the throttle valve 10.

The supercharger 8 is of a centrifugal type including a blower case 34 having a scrolled outlet portion 36. The bleed air conduit 32 opens at the upstream end to the scrolled outlet portion 36 of the blower case 34 and directed so that the ram pressure is applied thereto by the air accelerated by the blower. As shown in the drawing by a phantom line, the blower is connected with air exhaust gas turbine T provided in the engine exhaust gas passage. Thus, under a light load engine operation, there is no driving power applied to the blower and bleed air is drawn under the intake suction pressure prevailing in the intake passage 4 downstream of the throttle valve 10 through the air injecting nozzles 24 to thereby atomize the fuel injected from the fuel injecting valve 12. Under heavy load operation, the pressure at the outlet portion 36 of the blower case 34 is always maintained high as compared with the pressure at the downstream portion of the throttle valve 10 so that an effective air bleed is still maintained. In the illustrated arrangement, since the ram pressure is applied to the upstream end of the bleed air conduit 32, it is possible to maintain a strong bleed air stream.

The invention has thus been shown and described with reference to a specific embodiment, however, it should be noted that the invention is in no way limited to the details of the illustrated structures but changes and modifications may be made without departing from the scope of the appended claims.

We claim:

1. An intake system for internal combustion engines comprising: intake passage means provided with throttle valve means, supercharging means provided in said intake passage means upstream of the throttle valve means for compressing engine intake air to thereby supply the air under pressure to engine combustion chamber means through said throttle valve means, fuel injection means provided in said intake passage means downstream of the throttle valve means for injecting a metered amount of fuel to said intake passage means, airflow detecting means provided in said intake passage means for detecting engine intake air flow, control means responsive to an output of the airflow detecting means for controlling the amount of fuel injection from the fuel injection means in accordance with the output of the airflow detecting means, air bleed means for discharging bleed air to the fuel injected from the fuel injection means, said air bleed means including bleed air passage means separate from said intake passage means and having an upstream end opened to the intake passage means between said supercharging means and said throttle valve means and having a downstream end external and adjacent to said fuel injection means so as to discharge the bleed air directly to the fuel after it is injected into the intake passage means from the fuel injection means.

2. An intake system for internal combustion engines having engine housing means, said intake system comprising: intake passage means provided with throttle valve means, a portion of said intake passage means being formed through said engine housing means, supercharging means provided in said intake passage means upstream of the throttle valve means for compressing engine intake air to thereby supply the air under pressure through the throttle valve means, fuel injection valve mounting bore means formed in said engine housing means to open to said portion of the intake passage means downstream of said throttle valve means, socket means fitted to said bore means and having wall means formed with bleed air nozzle means penetrating said wall means, groove means formed around said socket means and communicating with said bleed air nozzle means, bleed air passage means having one end opening to said groove means and the other end to said intake passage means between said supercharging means and said throttle valve means, fuel injection valve means mounted on said socket means and having a fuel discharge end external to and located in the vicinity of said bleed air nozzle means so that bleed air from the nozzle means is discharged directly to the fuel after it is injected into the intake passage means from the fuel injection valve means.

3. An intake system for internal combustion engines having engine housing means, said intake system comprising: intake passage means provided with throttle valve means, a portion of said intake passage means being formed through said engine housing means, supercharging means provided in said intake passage means upstream of the throttle valve means for compressing engine intake air to thereby supply the intake air under pressure through said throttle valve means, fuel injection valve mounting bore means opening to said portion of the intake passage means downstream of said throttle valve means, socket means fitted to said bore means and having wall means formed with bleed air nozzle means penetrating said wall means, groove means formed around said socket means and communicating with said bleed air nozzle means, bleed air passage means having one end opening to said groove means and the other end to said intake passage means between said supercharging means and said throttle valve means, fuel injection valve means mounted on said socket means and having a fuel discharge end external to and located adjacent to said bleed air nozzle means so that bleed air from the nozzle means is discharged directly to the fuel after it is injected into the intake passage means from the fuel injection valve means.

4. An intake system for internal combustion engines having engine housing means, said intake system comprising intake passage means provided with throttle valve means, a portion of said intake passage means being formed through said engine housing means, supercharging means provided in said intake passage means upstream of the throttle valve means for compressing engine intake air to thereby supply the air under pressure through the throttle valve means, fuel injection valve mounting bore means formed in said engine housing means to open to said portion of the intake passage means downstream of said throttle valve means, socket means fitted to said bore means and having wall means formed with bleed air nozzle means penetrating said wall means, groove means formed around said socket means and communicating with said bleed air nozzle means, bleed air passage means having one end opening to said groove means and the other end to said intake passage means between said supercharging means and said throttle valve means, fuel injection valve means mounted on said socket means and having a fuel discharge end located in the vicinity of said bleed air nozzle means so that bleed air from the nozzle means is discharged directly to fuel injected from the fuel injection valve means.

5. An intake system in accordance with claim 4 which further includes airflow detecting means provided in said intake passage means for detecting engine air flow, and control means responsive to an output of the airflow detecting means for controlling the amount of fuel injected from the fuel injection means in accordance with the output of the airflow detecting means, said intake passage means having a portion formed as intake pipe means, said bleed air passage means having a first portion formed in said intake passage means and a second portion formed in said housing means to open to said groove means.

6. An intake system for internal combustion engines having engine housing means, said intake system comprising intake passage means provided with throttle valve means, a portion of said intake passage means being formed through said engine housing means, supercharging means provided in said intake passage means upstream of the throttle valve means for compressing engine intake air to thereby supply the intake air under pressure through said throttle valve means, fuel injection valve mounting bore means opening to said portion of the intake passage means downstream of said throttle valve means, socket means fitted to said bore means and having wall means formed with bleed air nozzle means penetrating said wall means, groove means formed around said socket means and communicating with said bleed air nozzle means, bleed air passage means having one end opening to said groove means and the other end to said intake passage means between said supercharging means and said throttle valve means, fuel injection valve means mounted on said socket means and having a fuel discharge end located adjacent to said bleed air nozzle means so that bleed air from the nozzle means is discharged directly to fuel injected from the fuel injection valve means.

7. An intake system in accordance with claim 6 in which said supercharging means is a turbo-supercharger.

8. An intake system in accordance with claim 6 which further includes airflow detecting means provided in said intake passage means for detecting engine air flow, and control means responsive to an output of the airflow detecting means for controlling the amount of fuel injected from the fuel injection means in accordance with the output of the airflow detecting means.

9. An intake system for internal combustion engines comprising intake passage means provided with throttle valve means, supercharging means provided in said intake passage means upstream of the throttle valve means for compressing engine intake air to thereby supply the air under pressure to engine combustion chamber means through said throttle valve means, fuel injection means provided in said intake passage means downstream of the throttle valve means for injecting a metered amount of fuel to said intake passage means, airflow detecting means provided in said intake passage means for detecting engine intake air flow, control means responsive to an output of the airflow detecting means for controlling the amount of fuel injection from the fuel injection means in accordance with the output of the airflow detecting means, air bleed means for discharging bleed air to the fuel injected from the fuel injection means, said air bleed means including bleed air passage means separate from said intake passage means and having an upstream end opened to the intake passage means between said supercharging means and said throttle valve means and a downstream end adjacent said fuel injection means so as to discharge the bleed air directly to the fuel injected from the fuel injection means.

10. An intake system in accordance with claim 9 in which said supercharging means is turbo-supercharging means wherein driving power is given by exhaust gas turbine means.

11. An intake system in accordance with claim 9 in which said supercharger means includes blower means having blower case means provided with an outlet portion, said upstream end of the bleed air passage means opening to the outlet portion of said blower case means.

12. An intake system in accordance with claim 9 in which said supercharging means includes centrifugal type blower means having blower case means provided with an scrolled outlet portion, said upstream end of the bleed air passage means opening to the scrolled outlet portion of said blower case means so that the upstream end of the bleed air passage means is applied with ram pressure.

* * * * *